US006604647B1

(12) United States Patent
Luburic

(10) Patent No.: US 6,604,647 B1
(45) Date of Patent: Aug. 12, 2003

(54) MOLDED CONTAINER AND LID HAVING STRATEGICALLY POSITIONED DRAINAGE OPENING

(75) Inventor: Frano Luburic, Costa Mesa, CA (US)

(73) Assignee: Ropak Corporation, Fullerton, CA (US)

( * ) Notice: Subject to any disclaimer, the term of this patent is extended or adjusted under 35 U.S.C. 154(b) by 0 days.

(21) Appl. No.: 08/881,520

(22) Filed: Jun. 23, 1997

(51) Int. Cl.[7] ..... B65D 17/34

(52) U.S. Cl. ..... 220/270; 215/254; 220/266; 220/268; 220/781; 220/780; 220/254; 220/380; 206/508; 222/541.9

(58) Field of Search ..... 215/250, 254, 215/256, DIG. 1, 307, 262; 220/335, 380, 263, 265, 266, 268, 269, 270, 780, 781, 790, 254, 712, 810, 831, 832, 836, 837, 367.1, 231, 271–273; 206/508; 222/541.9, 143; 229/404, 906.1

(56) References Cited

U.S. PATENT DOCUMENTS

| | | | | | |
|---|---|---|---|---|---|
| 1,596,638 | A | * | 8/1926 | Turpel et al. | 222/541.9 |
| 2,210,225 | A | * | 4/1940 | Walensky | 220/266 |
| 2,248,981 | A | * | 7/1941 | Gerth | 220/266 X |
| 3,084,835 | A | * | 4/1963 | Walsh | 220/265 X |
| 3,171,580 | A | * | 3/1965 | Davis et al. | 229/906.1 X |
| 3,303,957 | A | * | 2/1967 | Walter | 220/266 |
| 3,318,487 | A | * | 5/1967 | Edwards | 222/541.9 |
| 3,695,487 | A | * | 10/1972 | Slayton et al. | |
| 3,794,206 | A | * | 2/1974 | De Line et al. | 220/268 |
| 3,807,457 | A | * | 4/1974 | Logsdon | 220/266 X |
| 3,868,043 | A | * | 2/1975 | Freemyer | 220/712 |
| 3,938,695 | A | * | 2/1976 | Ruff | |
| 3,974,916 | A | * | 8/1976 | Bartolucci | 229/404 X |
| 4,085,861 | A | * | 4/1978 | Ruff | |
| 4,103,803 | A | * | 8/1978 | Irvine | 220/270 |
| 4,213,538 | A | * | 7/1980 | Boardman | 220/271 |
| 4,243,156 | A | * | 1/1981 | Lobbestael | 220/717 X |
| 4,252,247 | A | * | 2/1981 | Asbury | 220/271 X |
| 4,253,582 | A | * | 3/1981 | Shields | 220/269 |

(List continued on next page.)

FOREIGN PATENT DOCUMENTS

| | | | | |
|---|---|---|---|---|
| DE | 2341077 | * | 4/1974 | 220/265 |
| FR | 833719 | * | 10/1938 | 229/404 |

OTHER PUBLICATIONS

Attached photograph of a plastic coffee cup lid, available at Burger King.

*Primary Examiner*—Lee Young
*Assistant Examiner*—Robin Hylton
(74) *Attorney, Agent, or Firm*—J. Mark Holland

(57) ABSTRACT

A container includes first and second intersecting surfaces, and has at least one tearstrip opening to permit access to the contents of the container. The opening is positioned substantially at the intersection of those surfaces to permit drainage of substantially all of the contents of the container through the opening formed upon tearing of the tearstrip. Where the intersection is formed by a lid and a container wall, the lid has an outermost edge and the opening is positioned sufficiently near to the outermost edge to permit the desired drainage but also either does not tear the outermost edge (because the opening is sufficiently inwardly from the outermost edge) or does not destroy the hoop strength of a downwardly-depending hoop flange formed at the outermost edge. A plurality of such tearstrips may be provided and may be spaced from each other to provide pouring and/or venting in a variety of directions. The tearstrips may be provided with tab members to assist in their removal from the lid, and may be retained on the lid or completely removed depending upon the application. A shroud element protects the tearstrips from inadvertent dislodgment, and a resealing element closes the opening after removal of the tearstrip. A preferred method of use of the container lid is disclosed.

30 Claims, 13 Drawing Sheets

U.S. PATENT DOCUMENTS 4,279,358 A * 7/1981 Jacobs ..... 215/DIG. 1 X
4,333,583 A * 6/1982 Montemarano ..... 220/712
4,356,930 A * 11/1982 Roper ..... 206/508 X
4,421,244 A * 12/1983 Van Melle ..... 220/781
4,465,205 A * 8/1984 Sutch ..... 220/270 X
4,489,848 A * 12/1984 Braude
4,565,298 A * 1/1986 Taniuchi ..... 220/273
4,615,459 A * 10/1986 Clemente ..... 220/254
4,741,450 A * 5/1988 Braude ..... 220/254 X
4,836,404 A * 6/1989 Coy
4,915,250 A * 4/1990 Hayes, Jr. ..... 220/711
4,925,051 A * 5/1990 Herbst
4,949,865 A * 8/1990 Turner ..... 220/254 X
5,065,880 A * 11/1991 Horner ..... 229/906.1 X
5,076,425 A * 12/1991 Plone ..... 229/906.1 X
5,125,528 A * 6/1992 Heyn et al.
5,183,172 A * 2/1993 Boller ..... 220/254 X
5,197,624 A * 3/1993 Dodaro ..... 220/254
5,299,706 A * 4/1994 Wardell, Jr. ..... 220/254 X
5,398,843 A * 3/1995 Warden et al. ..... 220/254 X
5,415,313 A * 5/1995 Sang-Seo ..... 220/269
5,490,609 A * 2/1996 Lane et al. ..... 220/712
5,509,568 A * 4/1996 Warden et al.
5,522,521 A * 6/1996 Nagashio ..... 220/270 X
5,617,968 A * 4/1997 Luburic ..... 220/266 X
5,626,251 A * 5/1997 Luburic et al. ..... 215/256 X
5,645,191 A * 7/1997 Neville
5,906,288 A * 5/1999 Dwindell ..... 220/367.1

* cited by examiner

MOLDED CONTAINER AND LID HAVING STRATEGICALLY POSITIONED DRAINAGE OPENING

This invention relates to containers in general, and specifically to apparatus and method for improved pouring of fluid from a container. A tearstrip opening is provided substantially at the intersection of two surfaces of a container assembly, such as near a corner formed at or near the edge of a container lid. Among other things, that tearstrip opening is useful for pouring materials from the container, or venting air into the container as the contents are poured out another opening. The invention permits a more complete amount of the fluid to be poured from the container, and provides beneficial control over the flowrate and/or direction of pouring, as compared to prior art pouring mechanisms.

BACKGROUND OF THE INVENTION

Containers lids, especially those formed of plastic or similar materials, having "tearable" openings to permit removal of the container contents are well known. For example, although not necessarily relevant to the instant invention, coffee cup lids (such as provided by fast food restaurants) are commonly molded from thin plastic or similar material, and have one or more tearlines or areas formed therein to permit "tearing" an opening in the lid, whereby the coffee can be sipped through the opening while still keeping the coffee warm and while helping to reduce the risk of spilling.

Similar tearlines and related features also have been utilized on larger, more sturdy containers similar to the preferred embodiment of the invention, such as lids for conventional five-gallon injection-molded containers or the like. However, prior art container lids such as those shown in FIGS. 1–3 typically place such openings at least some distance from the edge of the lid. Consequently, during pouring some amount of fluid (illustrated as fluid 1 in FIG. 3) is "trapped" inside such prior art containers, in the space between the opening and the nearest edge of the container. In addition to the economic consequences of using less than all of the contents of the container, the inability to achieve substantially complete removal of the contents may create environmental problems, particularly in applications where the container contents are hazardous materials.

Some such lids (such as the coffee cup lids discussed above) have "tearable" openings whereby a flap is torn from the very outer edge of the lid toward the center. While this arrangement typically permits fairly complete drainage of the coffee from the cup (in that it exposes the lip of the cup), it destroys the continuity of the hoop flange formed at the outer edge of the lid and is therefore not necessarily useful for more rugged applications (such as for shipping containers and lids). Among other things, that hoop flange can provide a gripping hoop force that helps retain the lid on the container, and destruction or reduction of that hoop force can make it more likely that the lid will become inadvertently dislodged from the container or cup.

In addition, even if such an approach were taken for more rugged containers (such as the aforementioned conventional injection-molded five-gallon pails), tearing the hoop flange can expose a sealing gasket (if one is used) and similar complex structure between the lid and the container. Therefore, besides weakening the hoop force holding the lid in engagement with the container, some of the fluid can be caught in and around the exposed gasket and related engagement structure, causing a wasteful, messy, and even dangerous condition.

Openings for pouring fluid from prior art containers can be fairly complex. For example, they may include flexible "pull-out" spouts such as spout 2 (FIGS. 1 and 3). To use such a prior art pull-out spout 2, a user grips the bendable outer ribs 3 of a cap 4 threadedly engaged with the spout 2, pulls the ribs 4 (and correspondingly pulls the attached cap 3 and spout 2) until the spout extends from the container (such extension is shown in FIG. 3), and then unscrews and removes the cap 4 to open the spout for pouring (again, FIG. 3 illustrates the spout 2 with the cap 4 removed). The steps can be reversed to reseal the container. While such spouts provide some benefits over the prior art "no-spout" lids described in the following paragraph, they still do not allow relatively more complete drainage of the container.

Other prior art openings include tearable portions having gripping tabs to initiate the tearing. For example, FIG. 2 shows a screw-on cap 5 over a central tear-out portion (the tear-out portions is not shown because it is under the cap 5). The user removes the cap 5, tears the tear-out portion, and can then reseal the container by screwing the cap 5 back on.

In addition to not draining completely, such prior art container assemblies can also present several limitations with respect to a user's control over pouring. Container lids such as those shown in FIGS. 1 and 2, for example, will frequently "gulp" or "spit" contents out of their openings, particularly when the containers are initially full and there is no clear path for air to enter the container and replace the fluid as it is poured out (some containers include additional vent structures and openings that increase the cost and complexity of the container and do not completely solve the "gulping" problem, at least for initial pouring from full containers). This can lead to uneven and at least somewhat haphazard or imprecise pouring and spillage, which in turn result in economic loss, as well as environmental and health hazards in some applications. It can be especially difficult to obtain a small quantity of the fluid without wasting or spilling fluid, during "early pours" from such containers.

In addition, to be stackable (and especially to allow stacking of filled container and lid assemblies atop each other), prior art containers lids typically have any spout/fitment/drain openings "buried" so that they are generally flush with the upper surface of the lid (e.g., the pull-out spout 2 of FIGS. 1 and 3, as discussed above). This flush arrangement ensures that the spout 2 (in its retracted position) does not prevent or interfere with the stacking of another container on top of the lid. In effect, the prior art drain openings are relatively complicated structures because, at least in part, they must be retracted into the container to permit the desired stacking.

OBJECTS AND ADVANTAGES OF THE INVENTION

It is, therefore, an object of my invention to provide a container assembly with improved pouring features. The container of my invention is characterized by providing one or more tearstrip openings at or near the intersection of two surfaces of a container assembly, such as at the corner formed at the peripheral rim portion of a lid. In lid embodiments, the tearstrip opening is preferably substantially contiguous with the inner sidewall of a cooperating container. The tearstrip also preferably includes a tab member to facilitate gripping and tearing of the tearstrip.

Another object of my invention is to provide a stackable shipping container assembly with improved pouring features.

Another object of my invention is the provision of a container lid of the aforementioned character, in which at least one of the tearstrips is removable from the lid. Alternative embodiments include hinging the tearstrip to the lid (hinging is one of the ways the tearstrip would not be "removable"). Certain embodiments can include protective shrouds to prevent inadvertent dislodgment or tearing of the tearstrip, and resealing members such as screw-on caps.

A further object of my invention is thus to provide ecological and economic advantages over prior art containers and container and lid assemblies. Among other things, the benefits of reliably sealed transportation and handling of fluid are provided with less—or even zero—waste fluid unused and needing to be disposed, and the contents of the container (for which the user has paid) are more completely usable. As compared to the prior art spout devices, the costs of manufacturing the container are also reduced, and the costs and difficulties of assembly associated with such spouts present can also be eliminated.

Still another object of the invention is the provision of a plurality of such tearstrip openings of the aforementioned character on a single container assembly or lid. The openings can be of varied sizes and shapes, even on a single lid, or can all be similarly sized and shaped. One useful arrangement is a relatively large opening on one side of the lid (for pouring out the liquid) and a relatively small opening on the opposite side (to allow the container to "breathe" or "vent" during pouring, thus avoiding the "gulping" action that can otherwise occur when you pour liquid from a closed container). This venting arrangement can facilitate more precise control of the pouring of liquid (and even some granular solids) from the container, especially when the container is initially full. For different materials, or for different flow rates or applications, the fluid could be poured from the relatively smaller opening (and the relatively larger opening could be used as a vent).

A further object of my invention is the provision of a container lid of the aforementioned character, in which at least one of the tearstrips is configured to remain attached to the rim portion following tearing. In such embodiments, the rim portion also preferably includes a cooperating tearstrip retaining means to temporarily hold the tearstrip in a selected "open" position following tearing.

Another object of my invention is the provision of a container lid of the aforementioned character, in which the rim portion includes a shroud element configured to protect at least one of the tearstrips from inadvertent dislodgment.

Yet another object of my invention is the provision of a container lid of the aforementioned character, in which the rim portion includes a resealing member configured to permit closing at least one of the openings following removal of the tearstrip.

A further object of my invention is the provision of a container assembly for transporting fluid in an initially leak-proof condition, the assembly having first and second surfaces which intersect to form a corner and including a tearstrip that is removable to create a drain hole substantially aligned with one of the surfaces without significantly affecting the hoop strength of the container assembly at that location. Such an arrangement provides the aforementioned benefits of more complete drainage of the contents of the container. The corner can be relatively square or rounded, and the tearstrip opening can be on the top, bottom, or side of the container.

A still further object of the invention is the provision of a lid having a hoop flange depending downwardly from an outer edge thereof, in which the lid includes a tearstrip member positioned adjacent the flange to permit pouring out substantially all the contents of a container to which the lid is affixed. The pouring occurs through an opening formed by tearing the tearstrip, and the tearstrip is positioned so that the hoop aspect of the hoop flange remains intact upon tearing of the tearstrip.

An additional object of the invention is the provision of a method of pouring fluid from a container, including the steps of providing a container assembly with drainable contents therein; providing at least one tearstrip opening on the container so that tearing of the tearstrip does not tear any outer edge of the container, the opening being positioned to enable substantially all of the contents of the container to be poured therethrough upon tearing of the tearstrip; tearing the tearstrip; and pouring the contents from the container. The method can include providing a lid as part of the container assembly, with the at least one tearstrip being located on the lid.

In addition, the method can include the step of separating the tearstrips from the container assembly, and can include the step of tearing at least two substantially oppositely positioned tearstrips on the container assembly.

Yet another object of the invention is the provision of a container lid, including a central portion configured to be disposed over an opening of a cooperating container and a rim portion at the periphery of the central portion. One or more removable portions are provided on the rim portion in a position so that removal of the removable portions provides an opening through the lid into a cooperating container and the opening is adjacent to a sidewall of the container. Protective shield members may be provided adjacent the removable portions, as well as resealing means for covering the opening after removal of the removable portions.

Another object of the invention is the provision of an improved lid and container combination. The container has an opening thereon defined by a substantially vertical lip portion, and the lid is configured to cover the opening, with engagement means for maintaining desired engagement between the lid and the container. The lid includes a rim portion configured in a substantially upside-down U-shaped cross-section, the U-shape dimensioned and configured to substantially straddle the lip portion of the container. One or more removable sections of the rim portion are positioned adjacent the lip portion of the container and provide a passageway into the container upon removal of the one or more removable sections. A secondary vent opening may be provided, spaced from at least one of the removable sections, and may be constituted by a second removable section.

Yet another object of my invention is the provision of an improved container assembly of the aforementioned character, in which the assembly components are configured to permit nesting with other like components of the same size.

The invention also provides desirable tamper-evidencing as to the contents of the container.

Other objects and advantages of the invention will be apparent from the following specification and the accompanying drawings, which are for the purpose of illustration only.

DESCRIPTION OF PREFERRED EMBODIMENT

Figure 1:
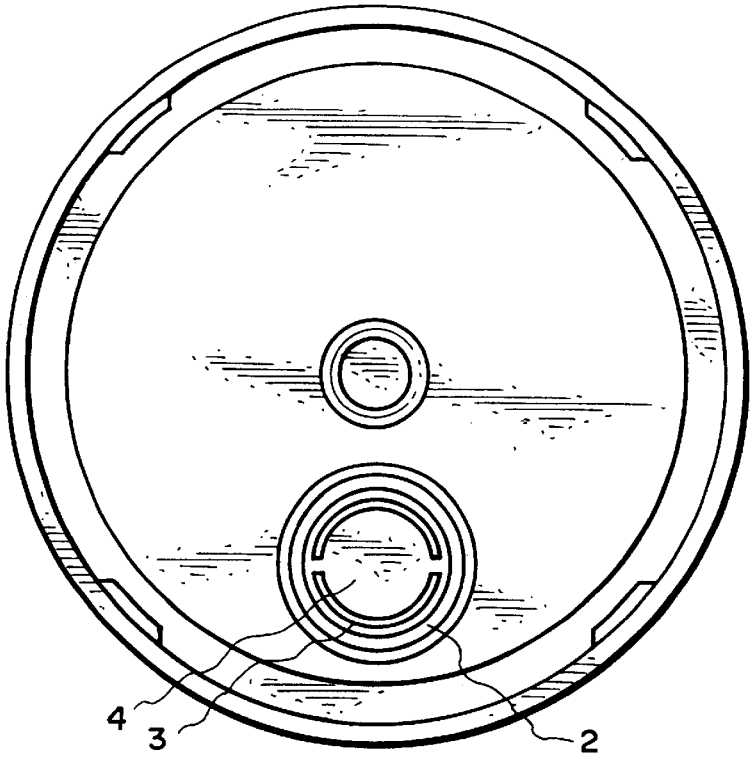
Fig. 1. PRIOR ART
FIG. 1 is a top view of a prior art container lid.
Figure 2:
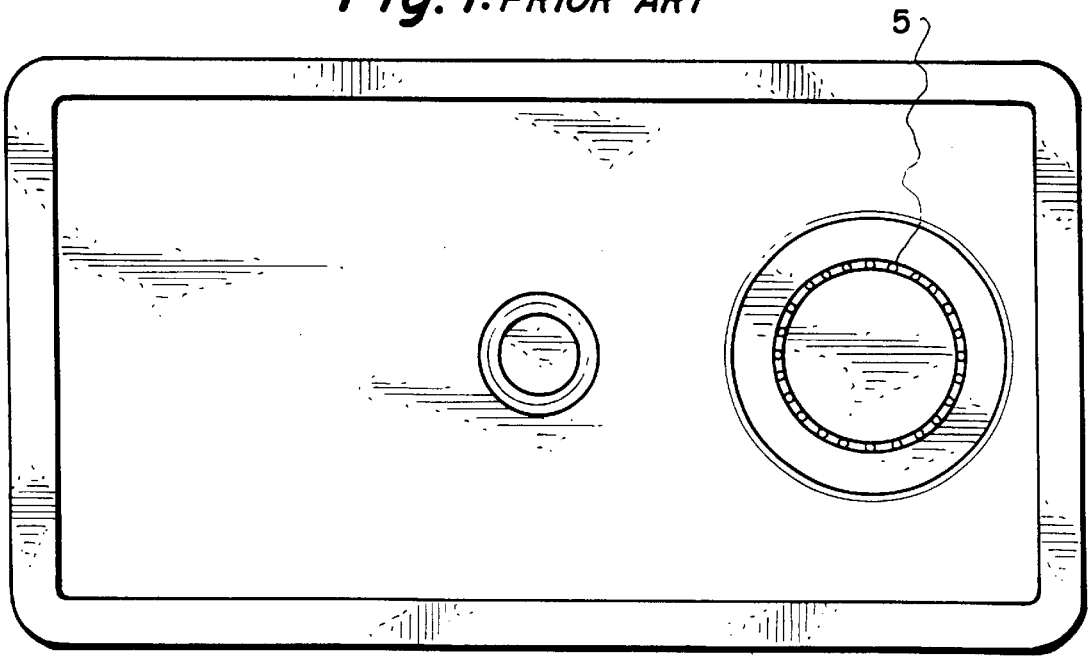
Fig. 2. PRIOR ART
FIG. 2 is a top view of another prior art container lid.
Figure 3:
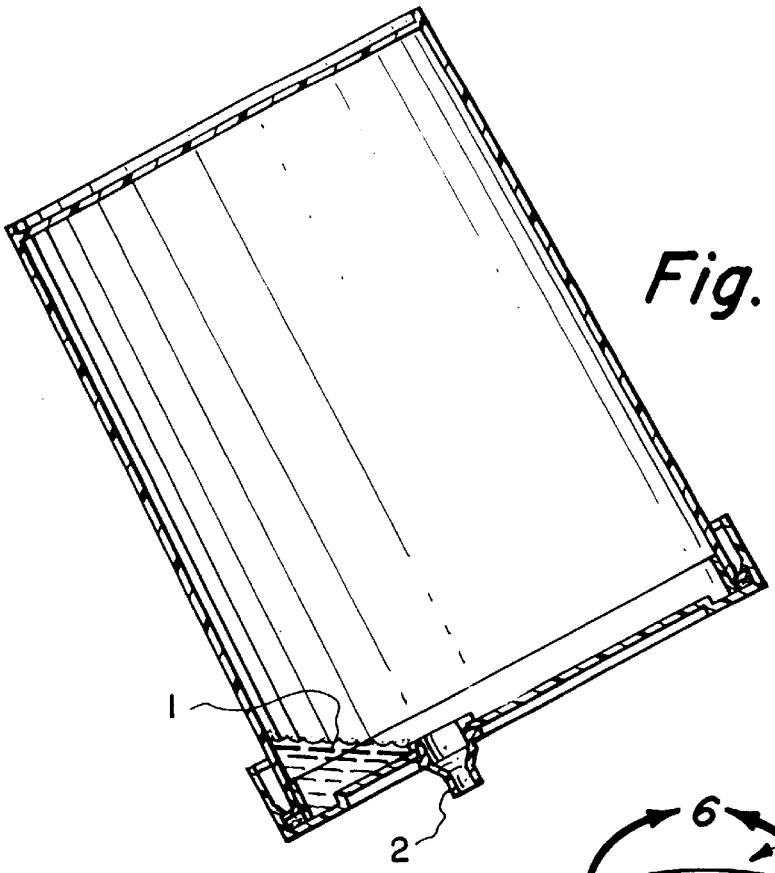
Fig. 3. PRIOR ART
FIG. 3 is a sectional view of a prior art container and lid assembly, illustrating fluid remaining in such a container after attempting to pour the fluid through an opening provided in the lid.

Referring now to the drawings, and particularly to FIGS. 4 and 6–8 thereof, I show a preferred embodiment of a container lid 100, constructed in accordance with the teachings of the invention. The more complete drainage achievable with the invention is illustrated in FIG. 5 (with the drops 6 indicating that virtually all of the fluid can readily flow out of the container 7), as is the combination of a prior art spout 8 with teachings of the invention. A comparison of FIGS. 3 and 5 illustrates the improvement in drainage over prior art devices and methods.

The container assembly and/or lid of my invention may be constructed and manufactured from any suitable material, but preferably is fabricated from suitably strong and resilient plastic or similar material, and preferably is formed by injection molding. Persons of ordinary skill in the art will understand, however, that a wide variety of materials and processes may be utilized to practice the invention.

Persons of ordinary skill in the art also will understand that my invention is useful in containers and lids of any known size, shape, and dimension, including by way of example and not limitation, circular, square, rectangular, ovular, and elliptical. Further examples of containers with which the invention may find use include, but are not limited to, those disclosed in U.S. Pat. No. 5,626,251 (to Luburic, applicant herein) and U.S. Pat. No. 4,6,930 (to Roper). Many of the concepts disclosed in those patents for engaging a lid to a container are also useful in various embodiments of the present invention.

Persons of ordinary skill in the art will also understand that, although the drawings herein principally illustrate an embodiment in which various features (such as the tearstrip opening, shroud, cap member, etc., as disclosed herein) are provided on a removable lid, certain aspects of the invention may be practiced by providing those features on the bottom of a container or on its sides (at the top or bottom thereof), or on the upper surface of a container having such an upper surface, so long as the opening is near a "corner" to permit draining of substantially all of the contents of the container.

Figure 4:
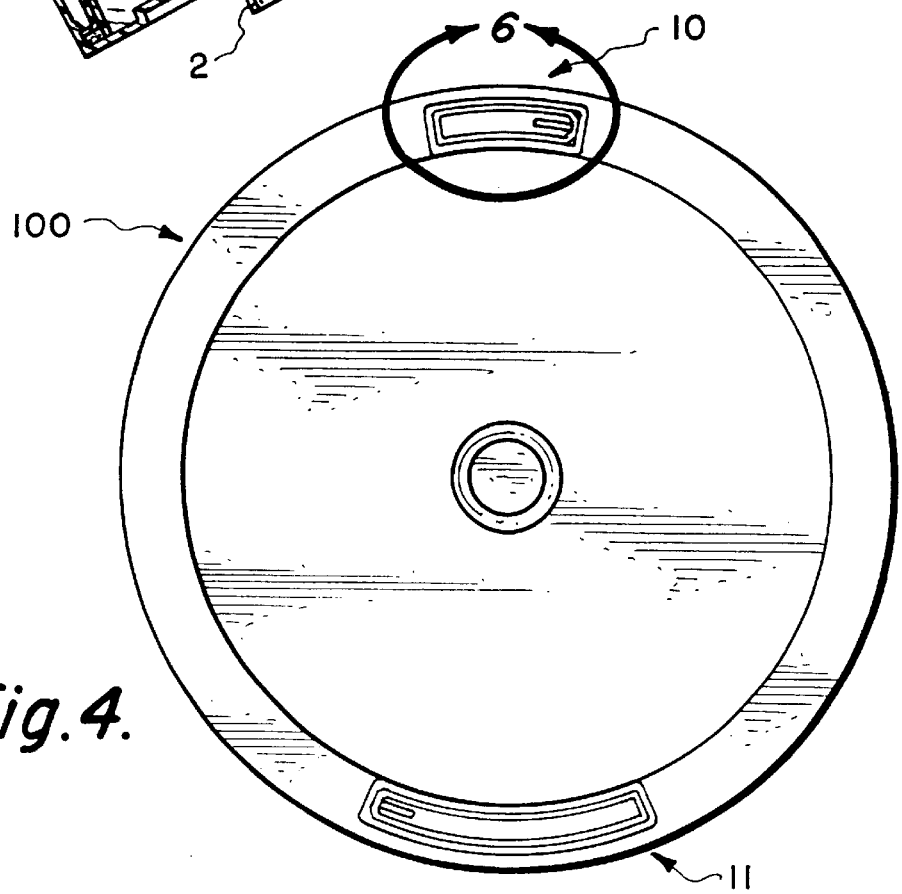
FIG. 4 is a top view of a preferred embodiment of a container lid constructed and fabricated in accordance with the teachings of the invention.
Figure 5:
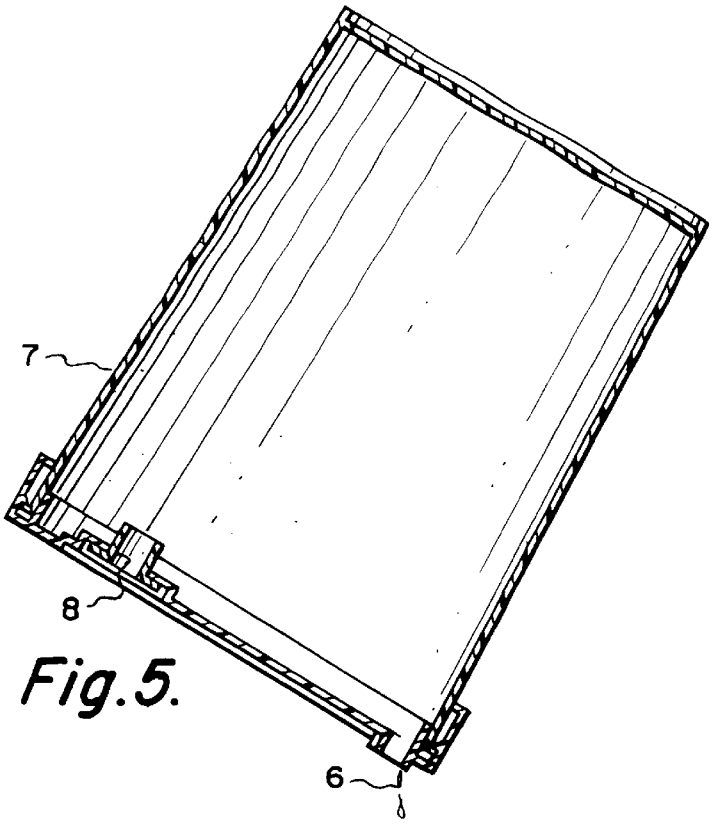
FIG. 5 a sectional view of a container and lid assembly, illustrating the substantially complete removal of contents from the container by employing the teachings of the present invention.

As illustrated in FIG. 4, the lid 100 includes a relatively smaller tearstrip opening 10 on one side of the lid and a relatively larger tearstrip opening 11 on the opposite side. Persons of ordinary skill in the art will understand that opening both of the tearstrips 10 and 11 in this configuration allows the container to vent or "breath" during pouring, and thus avoids the "gulping" action that can otherwise occur when pouring liquid from a closed container (especially a full container), as discussed above.

The configuration depicted in FIG. 4 (as well as other similar configurations) also facilitates more precise control over pouring, particularly when the container is initially full. For instance, depending upon the application, the fluid could be poured from the relatively smaller opening 10, and the relatively larger opening I1 could act as the vent. However, as persons of ordinary skill in the art will appreciate, and as illustrated in FIG. 5, embodiments of my invention include, by way of example and not by way of limitation, tearstrip portions such tearstrips strips combined with prior art structures (such as prior art primary spouts 8, or secondary vents or breathing holes).

Figure 6:
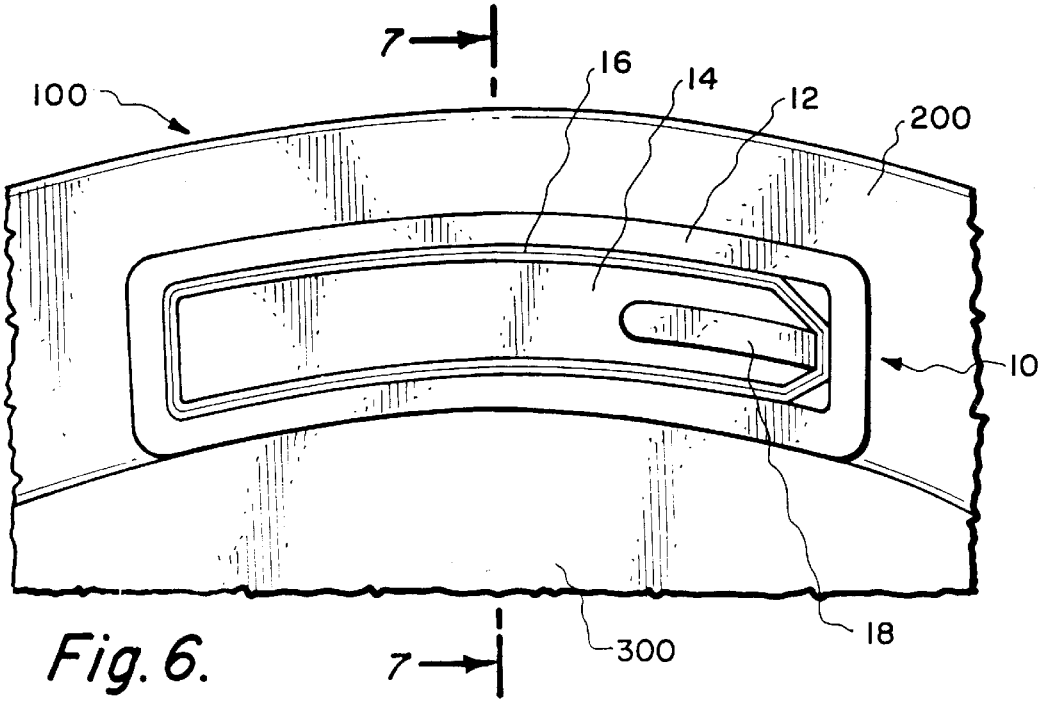
FIG. 6 is an enlarged view of the portion of FIG. 4 delineated by curved line 6.
Figure 7:
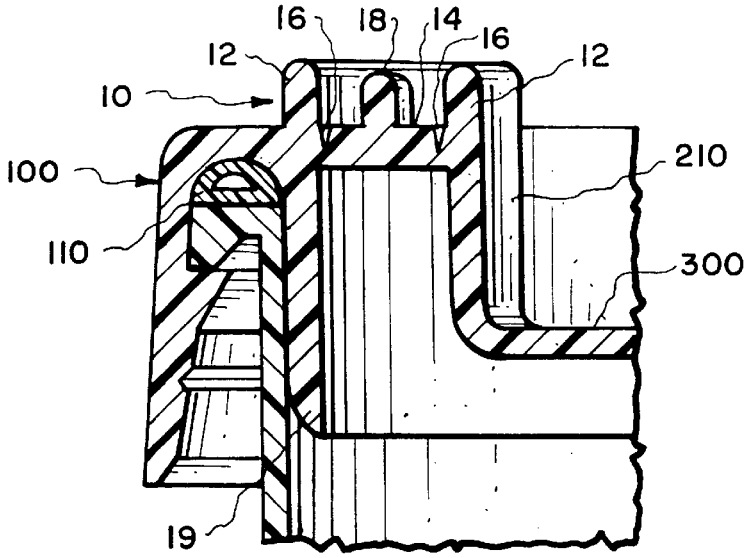
FIG. 7 is a broken sectional view taken along line 7—7 of FIG. 6.
Figure 8:
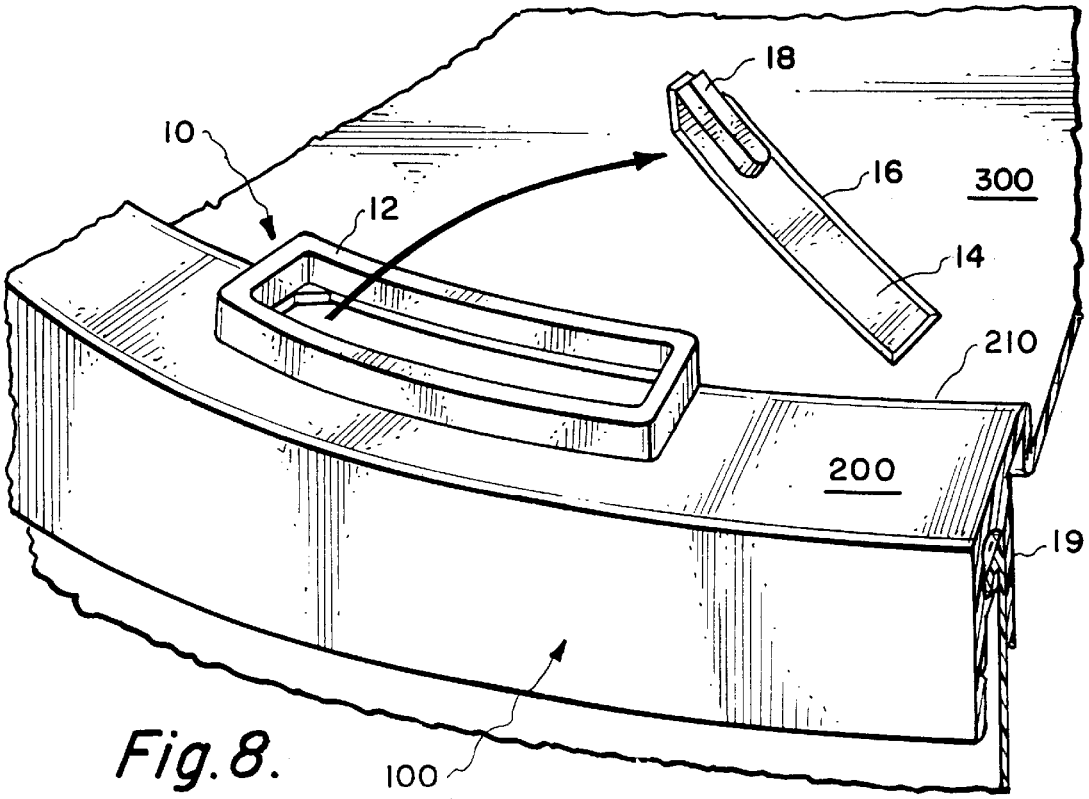
FIG. 8 is a broken isometric view of the lid of FIG. 4, illustrating removal of the tearstrip member.

Further details of a preferred embodiment of the invention are illustrated in FIGS. 6 and 7. Referring to FIG. 6, lid 100 includes a rim portion 200 surrounding a central portion 300. Opening 10 is illustrated as being preferably formed on the rim portion 200, although (as discussed elsewhere herein), it can be formed on other location on the container assembly.

As illustrated by the sectional view of FIG. 7, a protective shroud or shoulder 12 is preferably formed around a removable tearstrip 14 (persons of ordinary skill in the art will understand, however, that the protective shoulder 12 is not required to practice certain aspects of the invention).

A tearline 16 preferably defines tearstrip 14, and can extend completely around tearstrip 14 or for some less than complete distance therearound. By way of example and not limitation, as illustrated FIGS. 9 and 14–17, an "untorn" portion can serve as a hinge to allow the tearstrip to remain attached but be pivoted out of the opening that results from the desired tearing.

Figure 21:
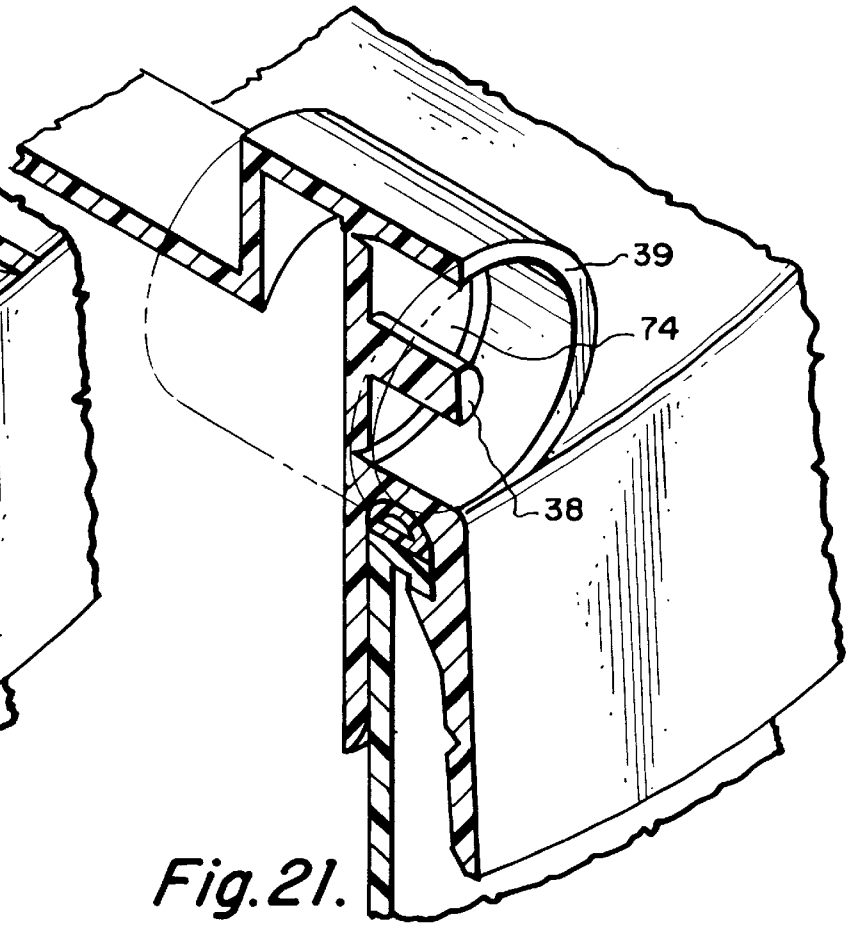
FIGS. 20 and 21 are broken isometric views illustrating some of the many other alternative embodiments of the invention.

A tab member 18 is preferably provided integral with or attached to tearstrip 14, to assist in initiating the desired tearing and/or to facilitate manipulation of tearstrip 14. Such tab members are especially desirable in applications employing the aforementioned "hinged" embodiments of the invention. In illustrations of such embodiments, tab member 48 in FIG. 9, tab member 28 in FIGS. 14–17, tab member 54 in FIG. 19, tab member 31 in FIG. 20, and tab member 38 in FIG. 21 illustrate various configurations of such tab members in facilitating opening of such an "untorn" hinged tearstrip. Persons of ordinary skill in the art will appreciate, however, that numerous other configurations are possible for such tab members, and that beneficial aspects of the invention may be practiced even without provision of any such tab member (in which case the tearstrip could, for example, be punched or pried open by the use of a screwdriver or similar tool).

Figure 10:
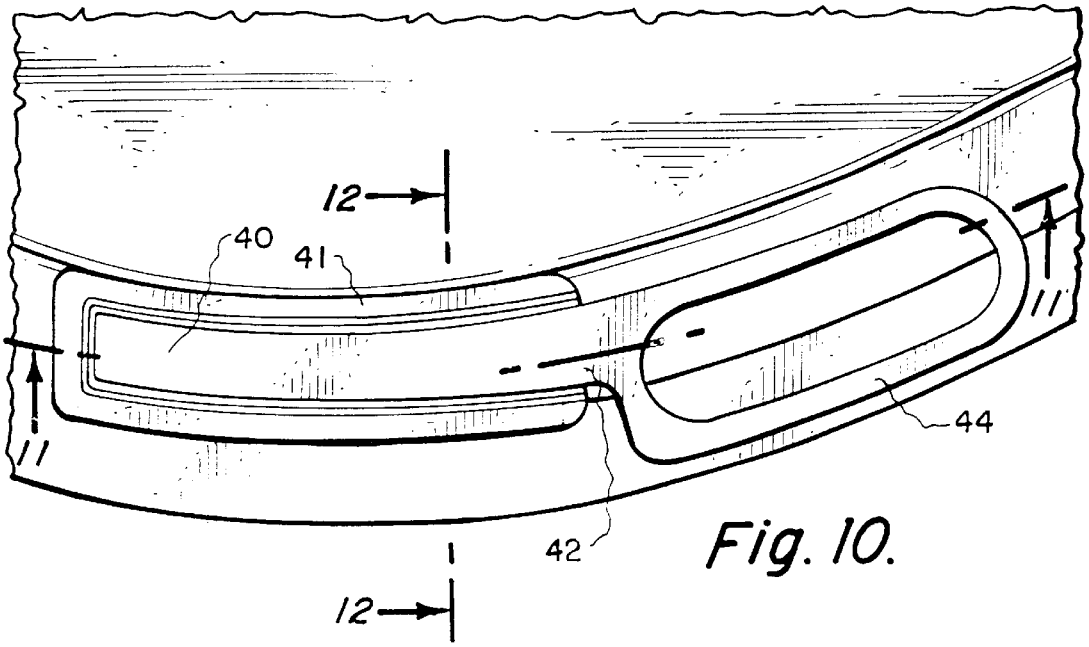
FIG. 10 is similar to FIG. 6, but illustrates one of the many alternative embodiments of a gripping member or handle element of the invention.
Figure 11:
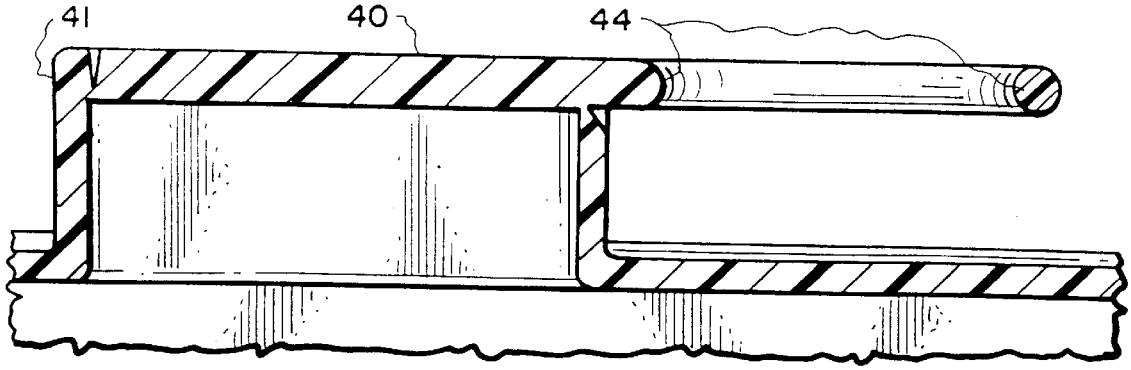
FIG. 11 is a broken sectional view taken along line 11—11 of FIG. 10.
Figure 12:
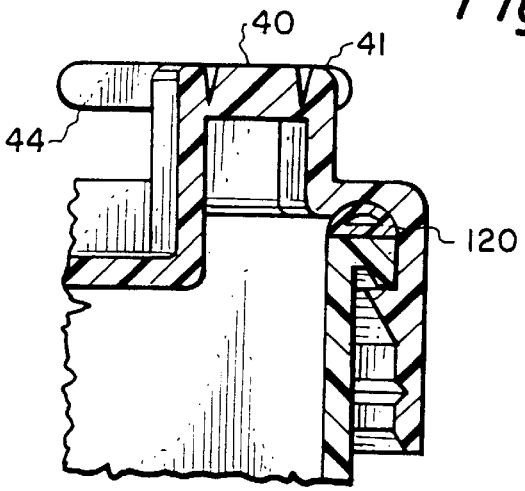
FIG. 12 is a broken sectional view taken along line 12—12 of FIG. 10.
Figure 24:
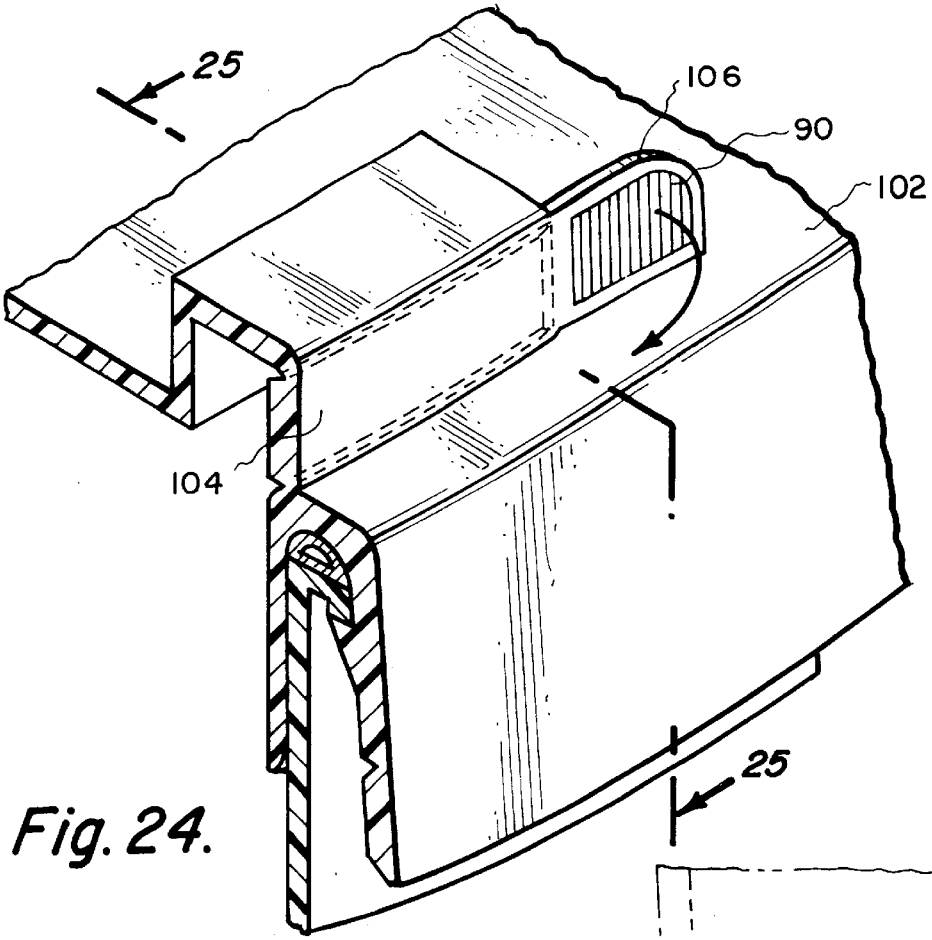
FIG. 24 is a sectional isometric view similar to FIG. 18, but illustrating yet another alternative embodiment of the invention.

Persons of ordinary skill in the art also will understand that, instead of a generally smooth tab member (as illustrated in the examples discussed above), ribs or other gripping means such as ribs 90, FIG. 24, or a pull ring such as ring 44, FIGS. 10–12, or some other useful structure, may be provided to facilitate gripping and/or pulling the tearstrip from the container at the time of opening same.

Figure 13:
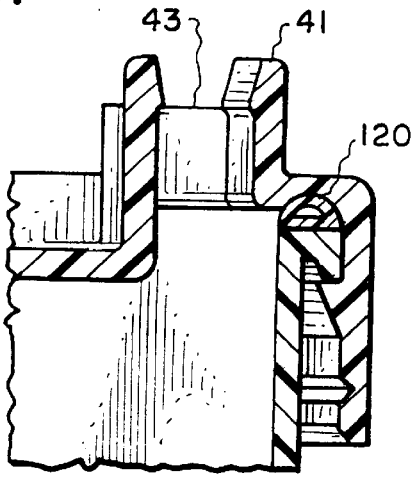
FIG. 13 is a similar to FIG. 12, but illustrates the lid after removal of the tearstrip member.
Figure 18:
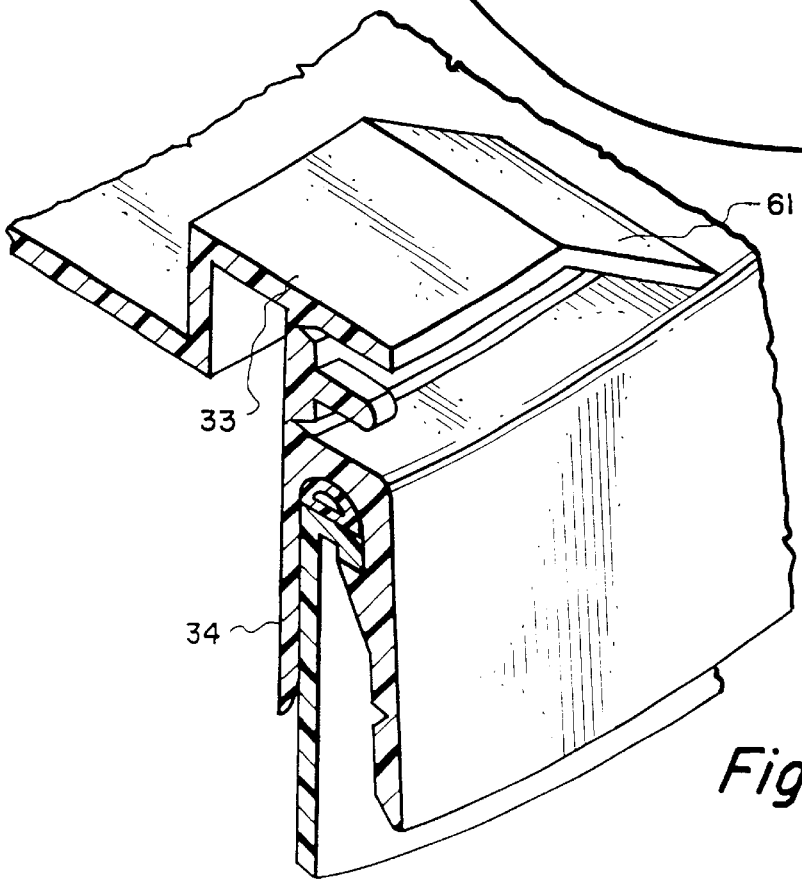
FIG. 18 is a sectional isometric view of another of the many alternative embodiments of the invention (similar to FIG. 19, below, but illustrating an embodiment without any central ribs 86 as shown in FIG. 19)

The alternative embodiment shown in FIGS. 10–13 also illustrates other advantages of the invention. As shown in those drawings, tearstrip 40 can be formed at the upper edge of the shroud or shoulder 41, and can include a handle 42 of any convenient shape and size. FIGS. 12 and 13 also illustrate that the invention is useful even if the lid has no inner skirt (such an inner skirt 19 is shown in the embodiment of FIG. 7, the skirt 29 in FIG. 15, or the skirt 34 in FIG. 18). Indeed, for lids without such an inner skirt, the resulting fluid flow through the tearstrip opening is even less impeded than in embodiments having an inner skirt 19, because the fluid or other contents can flow directly along the plane of the container sidewall, without "bumping" radially inwardly over an inner skirt.

FIG. 13 shows how a such an embodiment might appear after removal of the tearstrip apparatus 40, 42, 44. To further facilitate removal of that tearstrip, an undercut or scoreline (not shown) can be formed at surface 43, FIG. 13, between the handle 42 (already removed; see FIG. 10) and the underlying portion of shroud 41.

Figure 14:
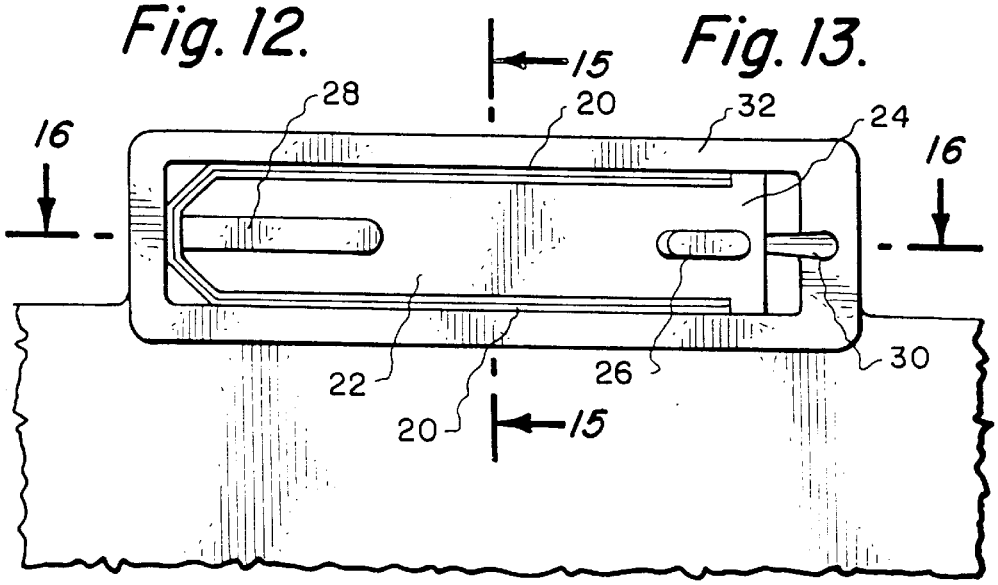
FIG. 14 is similar to FIG. 6, but illustrates another of the many alternative embodiments of the invention.
Figure 15:
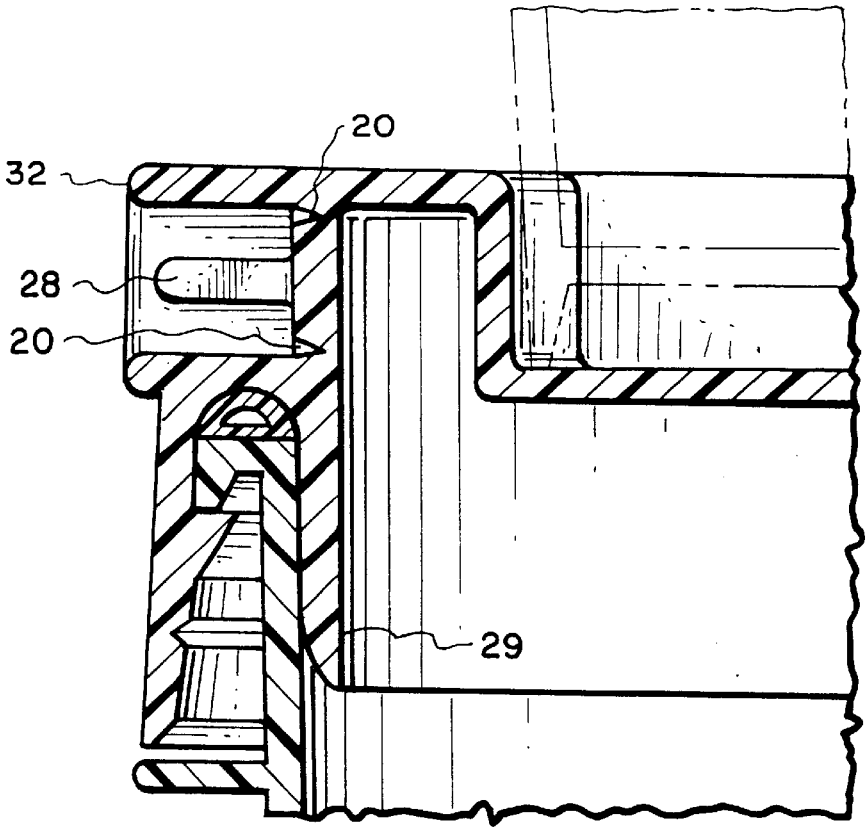
FIG. 15 is a broken sectional view taken along line 15—15 of FIG. 14.
Figure 16:
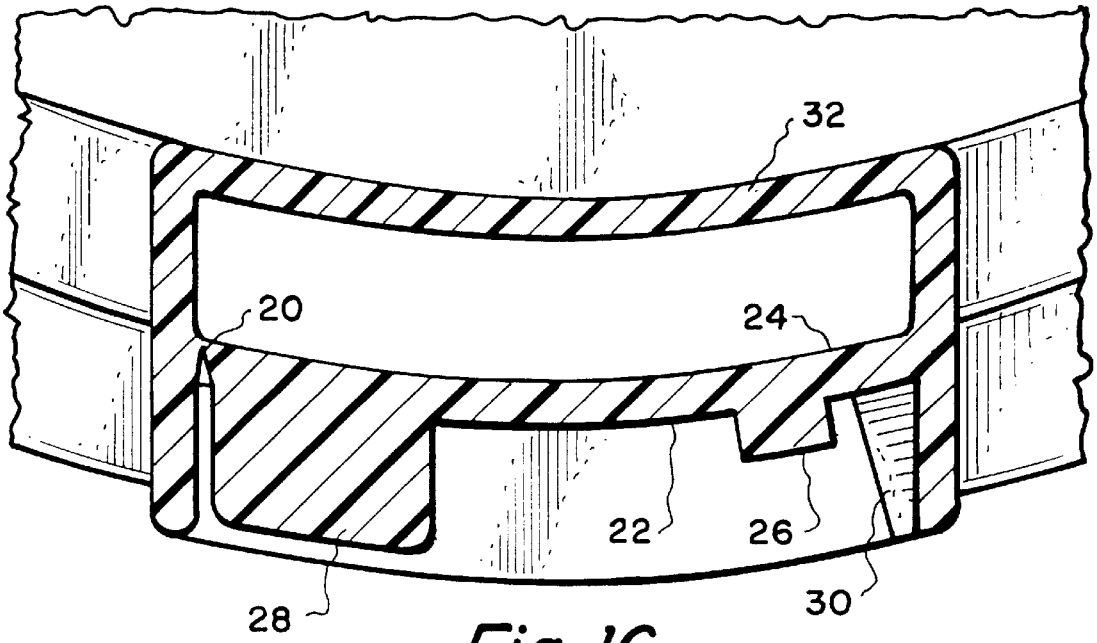
FIG. 16 is a broken sectional view taken along line 16—16 of FIG. 14.
Figure 17:
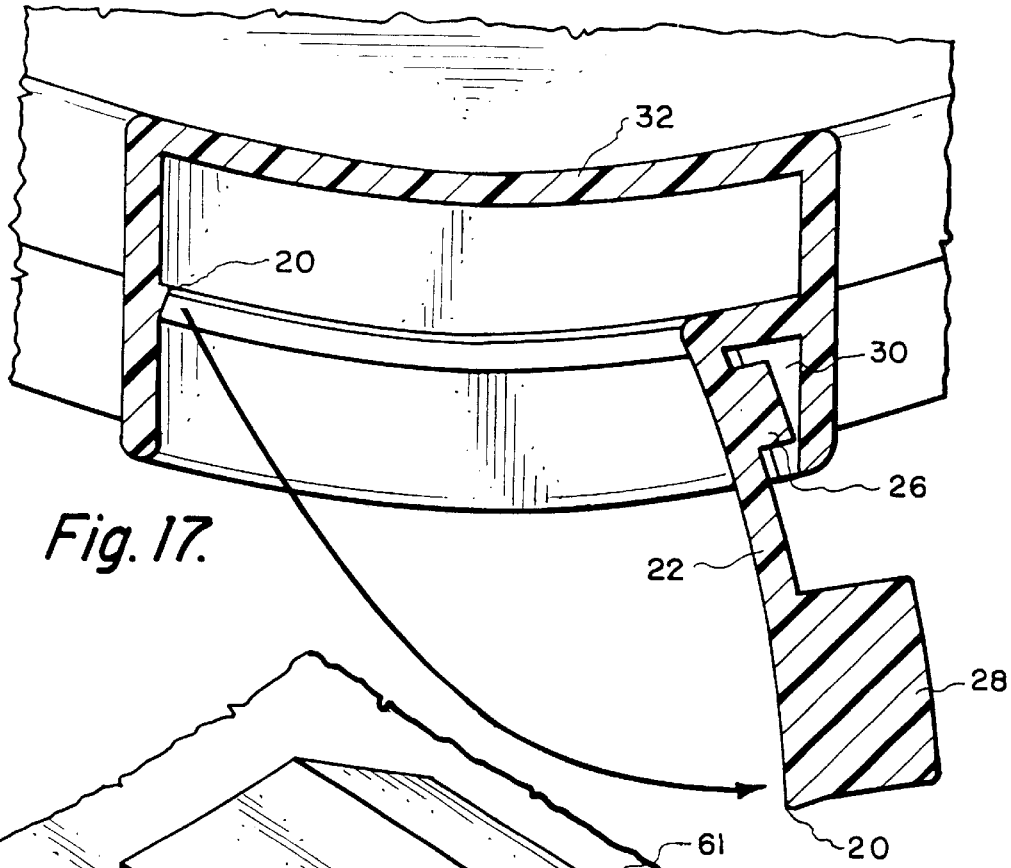
FIG. 17 is similar to FIG. 16, illustrating retention of a tearstrip member in an open position after tearing.

The alternative embodiment of FIGS. 14–17 shows still other aspects of the invention which are especially useful in connection with the aforementioned hinged tearstrip. In FIG. 14, scoreline or tearline 20 only goes around the bottom, left and top sides (as shown in the view of FIG. 14) of tearstrip member 22. The remaining (right) side of the tearstrip 22 remains attached to the rest of the lid, and functions as a hinge portion 24. A holding tab 26 is shown separate from the pull tab 28 (but tabs 28 and 26 can be formed as a single tab portion in other embodiments). Tab 26 is sized and configured to be temporarily frictionally gripped within the corresponding slot 30.

Figure 9:
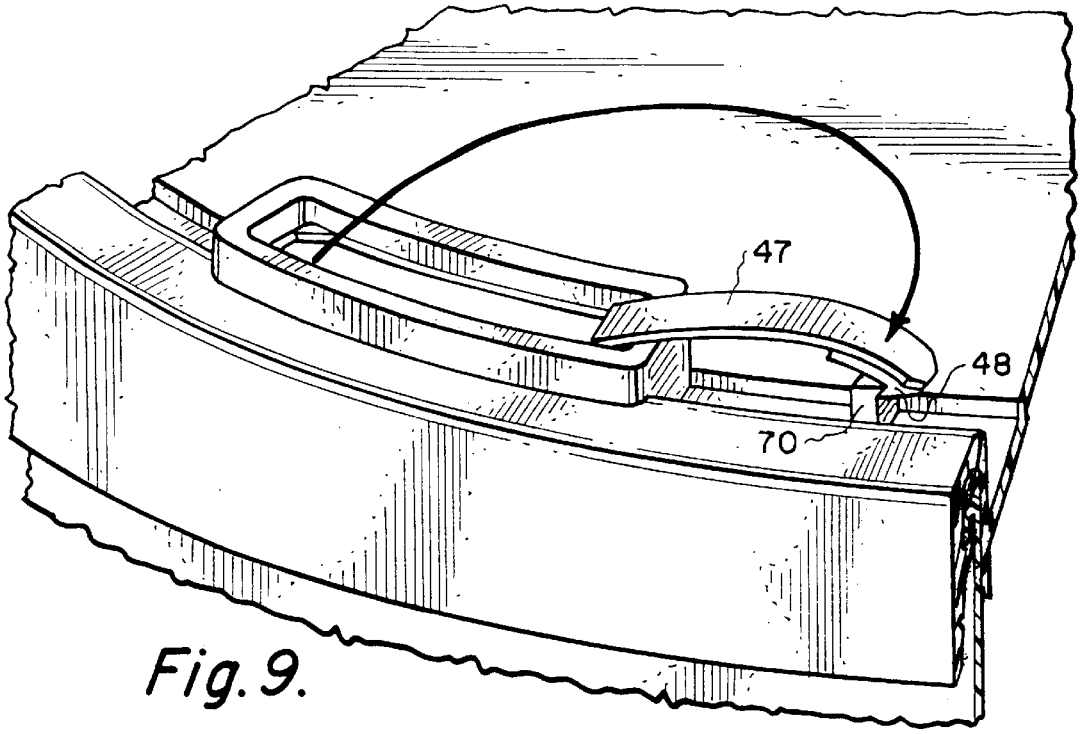
FIG. 9 is similar to FIG. 8, but illustrates an alternative embodiment in which the tearstrip member positioned radially further inward on the lid, and also illustrates one of many embodiments for retaining a hinged tearstrip in an open position.

In other embodiments, as illustrated by way of example and not limitation in FIG. 9, cooperating engagement members 70 and 48 can be provided to temporarily hold the hinged strip 47 open to permit, among other things, unobstructed pouring. In the embodiment of FIG. 9, the engagement of members 70 and 48 is preferably enhanced by the resilience and material memory of the hinged strip 47, which exerts a spring force tending to urge the strip 47 back toward its original, untorn position. Persons of ordinary skill in the art will appreciate that in such "hinged" embodiments, the cooperating engagement members may consist of interfitting friction-fit fingers, male-female snap-fitting devices, or any other convenient engagement mechanism. Similarly, persons of ordinary skill in the art will understand that if the tearstrip is properly molded, the tearstrip can be returned to its original untorn position, and adjacent torn edges on the tearstrip and on the container or lid can be subsequently interfitted with each other, so that the tearstrip provides at least some "covering" of the opening, although that covering would not be watertight.

FIGS. 14–17 also illustrate that the protective shroud shoulder (element 32 in FIG. 14) which protects the tearstrip 22 from inadvertent tearing or dislodgment, may be oriented other than upwards (which upwards orientation is illustrated in FIGS. 6–10). Persons of ordinary skill in the art will understand that a wide variety of orientations and configurations of the shroud 32 are useful, and can provide other useful functions in addition to the protection function described above.

By way of example and not limitation, the sideways orientation shown in the embodiments of FIGS. 14–21 and 24–26, can (among other things) act as a "spout" to help direct and control the flow out of the container in a direction other than directly away from the bottom of the container. Instead of allowing the potentially high-energy flow that can occur in various pouring operations (such as when the container is full of liquid and therefore has a high pressure "head" forcing liquid out of the opening) to gush straight out, shoulders such as 32 in FIGS. 14–16 can serve to deflect, direct and diffuse the flow, and thereby result in a more controlled pouring of liquid from the container. In the illustrated embodiments of FIGS. 14–21 and 24–25, for example, the diffused fluid flow is directed to the side of the container rather than away from the bottom of the container.

This flow-deflecting function can be useful in, and make easier, many applications. For example, in embodiments such as FIGS. 14–21 and 24–26, a user can tear open the tearstrip, turn the container (or lay it down with the tom-open tearstrip facing downwardly) so that the fluid flow is directed downward (for example) into a funnel or other container or hopper, etc. The user can then "walk away" while the fluid drains. Prior art containers, by way of containers, typically require much greater exertion and control by the user during the pouring process to make sure the fluid flows into the desired location. Typically, as the fluid pours out and the fluid head or pressure is correspondingly reduced in prior art container assemblies, the arc of the fluid flow (arcing away from the bottom of the container, rather than parallel to it as in FIGS. 14–21 and 24–26) changes, gradually becoming a straight-down dripping of fluid. Embodiments of the invention having the deflecting member, however, can provide a consistently-aimed fluid flow whose direction is unaffected by changes in the fluid pressure or head, as noted above. It may still be necessary to elevate the container above the pouring target (such as is necessary with prior art containers), but properly positioned and supported, the user can "walk away" during the draining cycle, as noted above.

Figure 26:
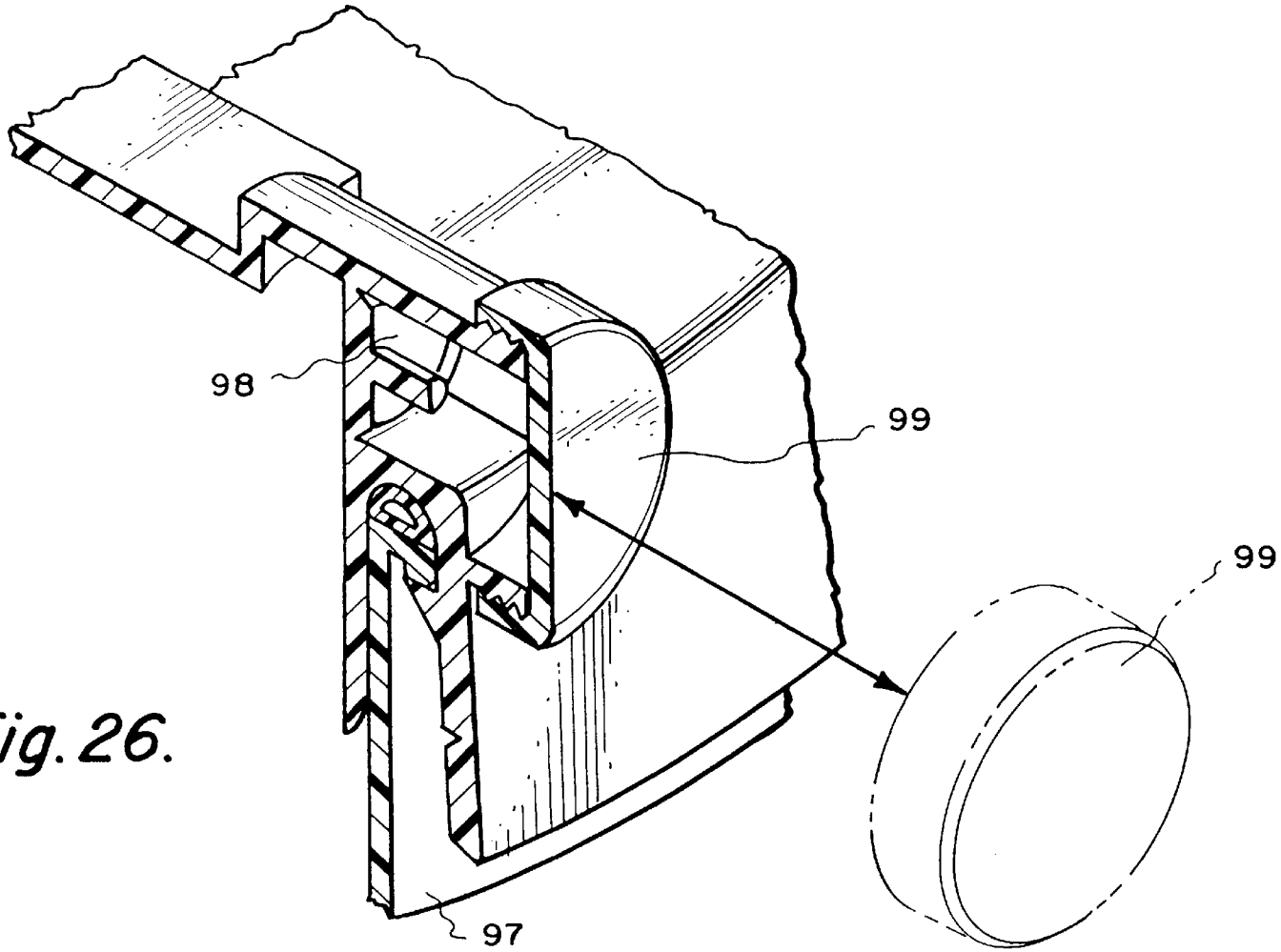
FIG. 26 is a sectional isometric view similar to FIG. 21, but illustrates one of the many embodiments of a cap member for closing or resealing the opening after tearing the tearstrip.

Many other "bent" or "deflecting" shroud 32 configurations and orientations are possible. Examples of such "deflector" shoulder configurations include, but are not limited to, deflector 33 in FIG. 18 (formed with one or more sloping support portions 61), deflectors 35 and 36 in FIG. 19, deflector 37 in FIG. 20 (covering tearstrip 64 and tab 31), and deflector 39 in FIG. 21, surrounding circular tearstrip 74. Persons of ordinary skill in the art will recognize that these shoulder-deflector-spouts can be molded into any convenient shape, including by way of example and not limitation, round, square, threaded (to receive a corresponding cap 99, as illustrated in FIG. 26).

Moreover, these shoulder-deflector-spouts can also help prevent foreign objects from being inserted (intentionally or unintentionally) into the container through the tearstrip opening. By way of example and not limitation (and again, as illustrated in FIG. 26), any well known prior art cover or cap (such as a screw-on cap 99, a snap-on cap, a hinged-on cover, etc.) may utilized in combination with such a shoulder to protect the tearable member from inadvertently being torn from the container prior to opening the container for pouring. Such caps may also function as convenient resealing mechanisms after the tearstrip is opened. The cap 99 is also shown in phantom as it might be removed to permit the tearstrip 98 to be pulled and/or to permit pouring of the contents from the container 97.

When used in combination with such shoulder-deflectors and/or shoulder-spouts, the preferred tearstrips of my invention are configured to be recessed "below" the top of such shoulders (in contrast to the embodiment shown in FIGS. 10–13), in order to protect the tearstrips from inadvertent dislodgment. In other words, referring again to FIG. 23, tearstrip 94 is preferably spaced below upper surface 95 of shoulder 92. However, persons of ordinary skill in the art will appreciate that such a protective configuration is not necessary or desirable in all applications, and that other protective devices (or none at all, as previously indicated) may be employed, depending upon the particular application.

Figure 19:
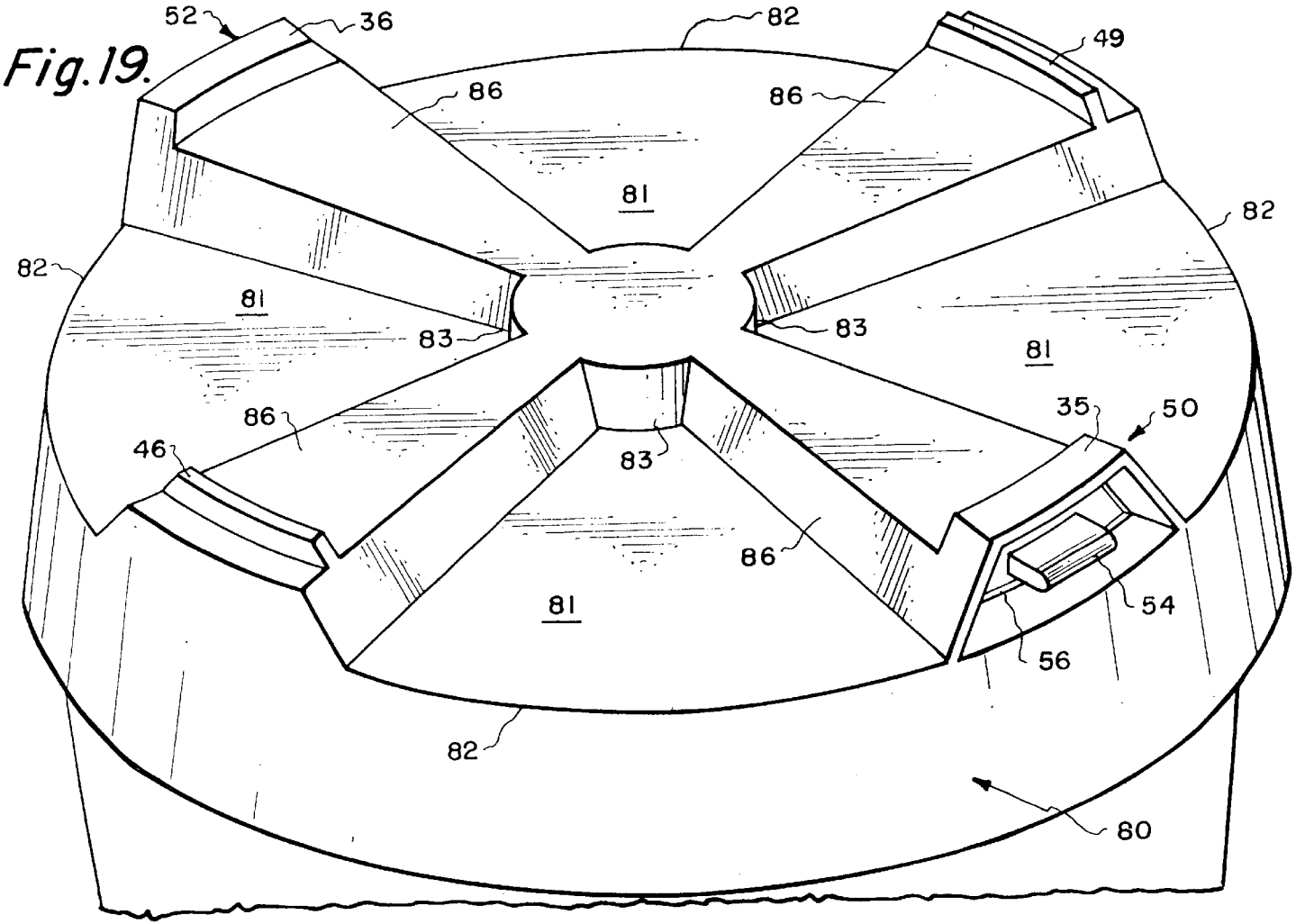
FIG. 19 is a broken isometric view of a container and lid combination, illustrating yet another of the many alternative embodiments of the invention.
Figure 20:
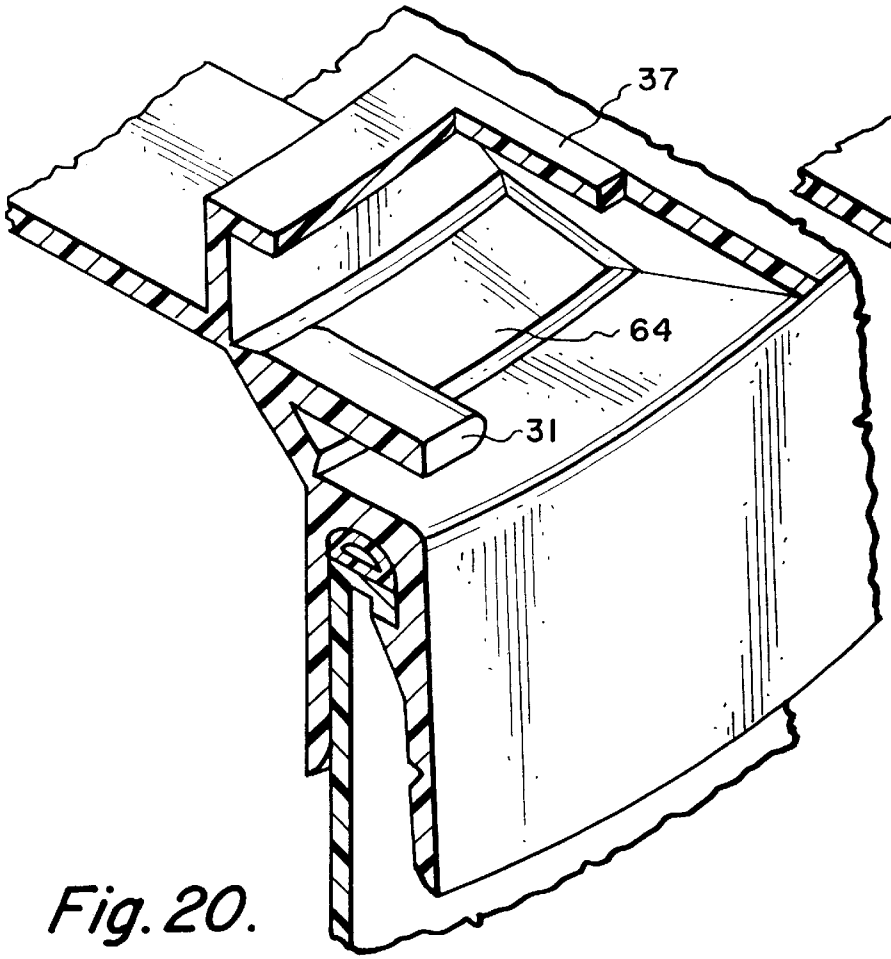

Again, FIGS. 19–21 illustrate but a few of the many possible useful configurations of such a shoulder-deflector-spout. Such shoulder-deflector-spout configurations also may be useful in combination with any or all of the other aspects of my invention. By way of example and not limitation, FIGS. 14–17 illustrate an inner skirt 29 in combination with a deflector 32.

Figure 22:
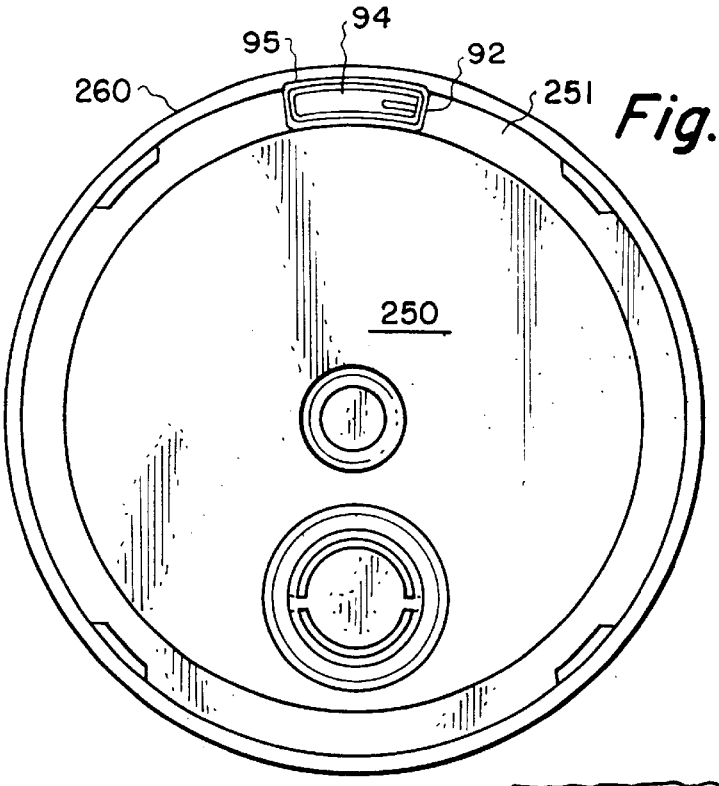
FIG. 22 is a top plan view of yet another embodiment of the invention, combining a tearstrip opening with a prior art vent opening, and showing the tearstrip portion positioned near the edge of a lid that is recessed but does not have a wide rim to help seat tapered containers thereon (therefore almost all of the opening is positioned on the central portion of the lid)
Figure 23:
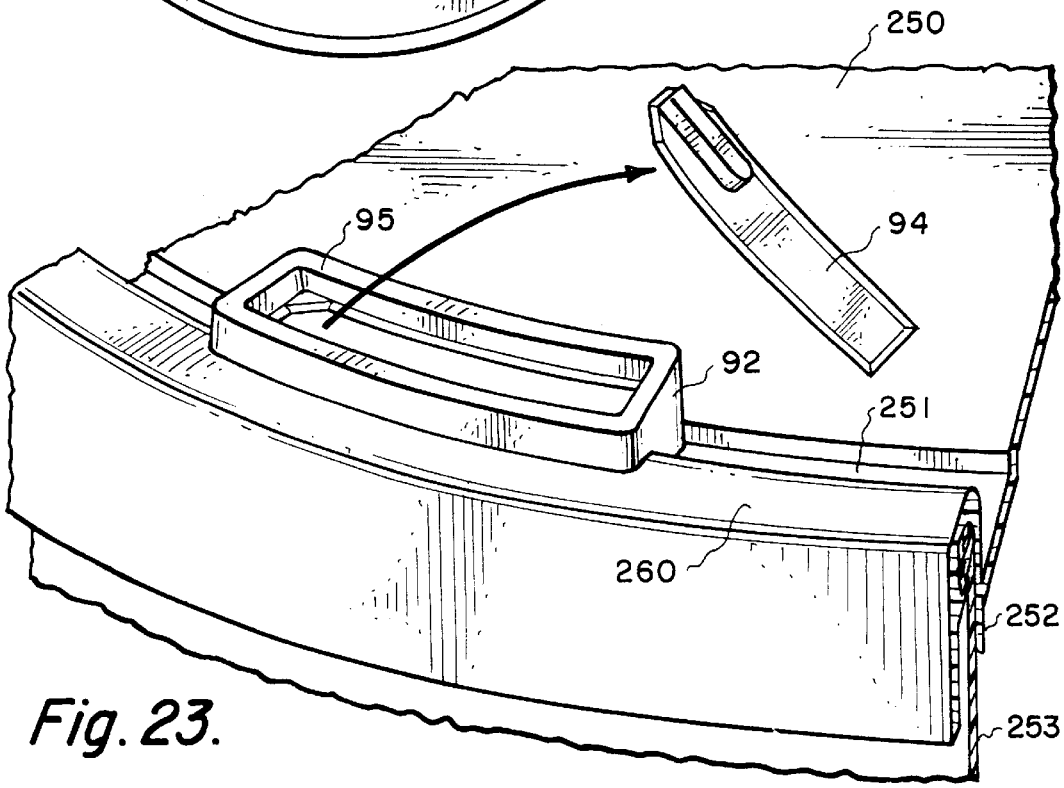
FIG. 23 is similar to FIG. 8, but illustrates the removability of the tearstrip of FIG. 22.

Certain aspects of the invention (such as the tearstrip and deflector combination) can be practiced even if the tearstrip is positioned other than completely atop the rim portion at the container edge. One such configuration is illustrated in FIGS. 22 and 23. FIG. 23 is similar to FIG. 8, but includes a channel 251 about the central lid surface 250, adjacent to rim portion 260. An inner skirt 252 can be provided, depending downwardly adjacent the container sidewall 253. As shown in FIG. 23, protective shoulder 92 may partially straddle rim portion 260 and channel 251.

The invention may be usefully incorporated with numerous container lids and container assemblies. By way of example and not limitation, the embodiments of FIGS. 19–21 illustrate how the invention might be incorporated into a lid 80 having a raised reinforcement portions 86. This embodiment can also be described as a "dry-top" lid, because it has no recessed portions in which liquid, dirt, rain, etc. might otherwise collect. Referring particularly to FIG. 19, apart from reinforcement portions 86, the entirety of lid surface 81 is flat or sloped to run-off toward its outer edges 82 from its corresponding inner edges 83.

In other words, the embodiment of lid 80, FIG. 19, is not recessed or "dipped down" into the container (such as the lids shown, for example, in FIGS. 8 and 9), but is relatively flat except for the portions 86, and any related deflector structure 35 and/or rib members 46 and 49, (discussed more fully below) with which such reinforcement portions may be combined. This type of lid differs from the previously-described "recessed" lids for use on containers that having tapered sidewalls to enable nesting of empty containers. Those recessed lids for tapered containers typically have a gap (such as, for example, the gap between the inner skirt 19 and an inner vertical wall 210 of rim 200 on lid 100 in FIG. 7) through which the contents of the container can be poured because the wall 210 is spaced radially inwards to contact the tapered (slightly smaller size) bottom of a container stacked on top of the lid, to assist in stacking of filled tapered containers atop each other (for example, on a pallet or other storage arrangement). Even for containers that are not recessed (and therefore do not have the aforementioned "gap"), there is room for the preferred tearstrip (similar to FIGS. 6, 8, etc.) at the edge of the lid if the container sidewall is tapered.

Persons of ordinary skill in the art will understand that the portions 86, FIG. 19, can be of any useful configuration on the lid (such as having 2, 3, 5, or more arms instead of the 4 shown), and tearstrip openings (similar to those previously described) can be provided in connection with one or more of the portions 86 generally adjacent the outermost edge of the portions 86. The embodiment of FIG. 19, for example, includes two tearstrip openings 50 and 52. Each opening 50 and 52 can be provided with tab members 54 affixed to tearstrips 56, recessed below protective shoulders 35 and 36, respectively, but persons of ordinary skill in the art will understand that that any of the pull ring or other gripping mechanisms discussed herein may be used in this type of embodiment as well.

In addition, for any arms 86 which do not have tearstrips structures such as tearstrip portions 50 and 52, it is useful to provide corresponding elements such as seating members 46 and 49 (which are not tearstrip openings) to assist with stacking of similar containers atop the lid. Persons of ordinary skill in the art will understand that a container can be readily stacked atop the lid 80 and its bottom seated in an abutting relationship against the seating members 46 and 49, as well as against tearstrip portions 50 and 52. The elements 46, 49, 50 and 52 help prevent the container on top from sliding off of, or otherwise becoming misaligned from, the supporting lid 80.

In certain applications, containers and lids employing my invention may also include sealing gaskets. By way of example and not limitation, gasket 110 in FIG. 7 and gasket 120 in FIGS. 12 and 13 depict such arrangements. In the preferred embodiment, leaking of the container contents (particularly when the contents are liquid) past these gaskets during pouring is not an issue, because the gasket sealing remains intact. Indeed, for embodiments with inner skirts on the lid (see skirt 19 in FIG. 7, for example), the liquid may never even contact the gasket during pouring or otherwise.

As indicated above, the container/lid combinations of my invention also are preferably stackable. Persons of ordinary skill in the art will understand that the recessed configuration of central lid surface 300 below rim portion 200, FIG. 8., makes it less likely that a container atop lid 100 will be inadvertently toppled from its stacked relationship with the underlying lid 100.

Figure 25:
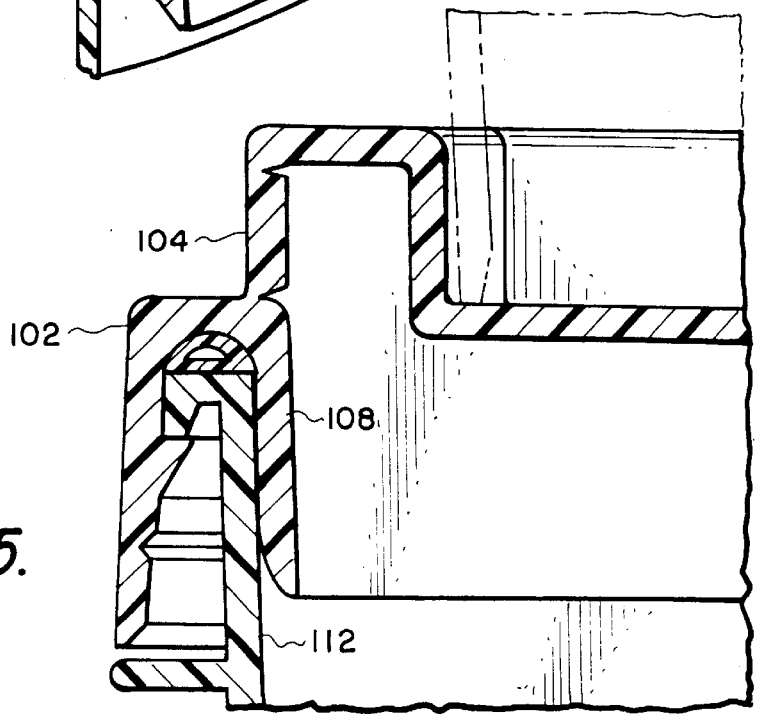
FIG. 25 is a sectional view taken along line 25—25 of FIG. 24.

FIGS. 24 and 25 illustrate still another embodiment of the invention, in which a lid 102 is provided with a tearstrip section 104 affixed to a tab member 106 having a ribbed area 90.

Persons of ordinary skill in the art will understand that other embodiments (not shown, but some of which have been alluded to above) include, without limitation, a container in which there is no separate lid member, or in which the tearstrip opening is provided on the container body rather than the lid. In such embodiments, the tearstrip opening is preferably located adjacent the intersection of two walls of the container, to permit the improved drainability described herein. For example, if elements 108 and 112, FIG. 25, were initially formed as a single structure, the provision of the opening resulting from removal of the tearstrip 104 would still provide the improved drainability described herein.

Likewise, and as indicated above, the tearstrip portion of the invention can be located on any suitable area of the container, including, for example, on the bottom, the side (at the top or bottom thereof) or at any other intersection of surfaces forming a corner. A view of such a "bottom" tearstrip embodiment would be similar to FIG. 4, and some other structures (such as tabs, not shown, halfway between each of the structures 10 and 11 on the rim portion) would be required as "feet" to provide a balanced support on which the container would sit. In such embodiments, if the tearstrip portion were "below the fluid line" when the container was in its normally upright position, the container could be laid on its side or otherwise turned over and positioned so that the tearstrip were positioned "above the fluid line" for tearing.

As indicated above, the invention is useful in connection with stackable shipping container assemblies. Persons of ordinary skill in the art will understand that the drain opening of the invention can be formed or provided at locations on the container and/or lid that do not interfere with the stacking of filled container and lid assemblies atop each other. Accordingly, unlike prior art containers, there is no need to "bury" the tearstrip structure and/or the surrounding shroud or otherwise make them generally flush with the surrounding surface of the container or lid. For example, in embodiments in which the drain opening is provided near the edge of the lid, the stacked container abuts the central lid portion (rather than the rim portion) and the tearstrip opening structure is thus positioned outside of the abutting surfaces. An extension of the tearstrip opening structure or its surrounding deflector shroud beyond the surface of the rim can thus exist without affecting stackability.

The apparatus of the invention is useful in a preferred process for pouring fluid from a container assembly. By providing a container assembly including drainable contents, in which the container includes at least one tearstrip to provide an opening into the container upon tearing of the tearstrip, positioned so that tearing of the tearstrip does not tear any outer edge of the container. The opening is positioned to enable substantially all of the contents of the container to be poured therethrough upon tearing of the tearstrip, the tearstrip is torn, and the contents are poured from the container. By providing a lid as part of the container assembly, the tearstrip can be located on the lid. Additional alternative process steps include providing and removing removable tearstrips, providing and tearing at least two tearstrip openings positioned on substantially opposite sides of the container lid, and providing a cover for the tearstrip, removing the cover, tearing the tearstrip, and replacing the cover after the pouring step.

Thus, by my invention, I provide a container assembly with improved pouring features and a preferred method for using same. Persons of ordinary skill in the art will understand that, in addition to permitting a more complete pouring of materials from a container, my invention eliminates the need for costly prior art spout devices (although they can be used complementarily within the same embodiment), and offers the user improved control over numerous container drainage parameters, including by way of example and not limitation, pouring precision, rate and direction.

The apparatus and method of my invention have been described with some particularity but the specific designs, constructions and steps disclosed are not to be taken as delimiting of the invention in that various modifications will at once make themselves apparent to those of ordinary skill in the art, all of which will not depart from the essence of the invention and all such changes and modifications are intended to be encompassed within the appended claims.

What is claimed is:

1. In a lid for a shipping container, the combination of a central portion of said lid connected to a rim portion of said lid, said rim portion having an outermost edge and at least one downwardly projecting flange; said downwardly projecting flange including detent means for helping prevent undesired dislodgement of said lid from the container during normal handling, stacking, and transportation thereof; said rim portion being generally defined at an interior edge thereof by a generally vertically oriented section spaced inwardly from said outermost edge; and at least one tearstrip opening in said rim portion to permit access to the contents of the container, in which said opening is positioned sufficiently inwardly from said outermost edge that tearing said tearstrip opening does not tear said outermost edge, and said opening is positioned sufficiently near to said outermost edge to permit drainage of substantially all of the contents of the container upon tearing of said tearstrip opening and pouring the contents therethrough.

2. The lid of claim 1, in which said at least one opening is positioned substantially adjacent a sidewall of the container.

3. The lid of claim 1, in which said at least one tearstrip opening is positioned completely within said rim portion and not in said central portion.

4. The lid of claim 1 or claim 2 or claim 3, including hinge means by which said tearstrip remains attached to said rim portion following tearing of said tearstrip.

5. The lid of claim 4, including cooperating tearstrip retaining means on said lid to temporarily hold said tearstrip in a selected position away from said opening following tearing.

6. The lid of claim 1 or claim 2 or claim 3, including a shroud adjacent said tearstrip to protect said tearstrip from inadvertent dislodgment.

7. The lid of claim 1 or claim 2 or claim 3, including a resealing member adjacent said at least one tearstrip to reclose said at least one opening following tearing of said tearstrip.

8. The lid of claim 1 or claim 2 or claim 3, in which at least two such tearstrip openings are provided in spaced relationship from each other.

9. The lid of claim 8, in which said at least two such tearstrip openings are on opposite sides of said lid.

10. The lid of claim 8, in which said at least two such tearstrip openings are of different sizes.

11. The lid of claim 8, in which said at least two such tearstrip openings are of different shapes.

12. A container lid, including a bead member thereon for snapping engagement with an associated container, further including a plurality of tearstrips formed slightly inwardly of an edge of said lid and sufficiently near said edge to permit drainage of substantially all of the contents of an associated container through an opening formed by tearing at least one of said tearstrips, in which at least one of said tearstrips is formed under a protective shroud member, said shroud member having an opening to permit access to and manipulation of said at least one tearstrip.

13. The container lid of claim 12, in which at least one of said tearstrips is removable from said lid.

14. The container lid of claim 12, in which at least one of said tearstrips is at least partially defined by a tearline formed in said lid, and said tearline does not completely encompass the periphery of said tearstrip, whereby said tearstrip remains attached to a rim portion of a mating container following tearing.

15. The container lid of claim 12, including a cooperating engagement slot and mating engagement tab formed on said lid and said at least one of said tearstrips to hold said tearstrip away from said opening after tearing.

16. The container lid of claim 12, including a threaded cover member engageable with mating threads provided adjacent said at least one of said tearstrips to cover the opening formed by tearing the tearstrip.

17. A container assembly for transporting flowable material in an initially substantially leak-proof condition, said assembly being molded from plastic, said assembly having first and second surfaces which intersect and second and third surfaces which intersect, those surfaces and intersections generally forming an elongated channel, said channel generally positioned at a corner of said assembly when said assembly is viewed in cross-section, said assembly further including a tearstrip substantially positioned in said channel, said tearstrip being tearable to permit drainage of substantially all of the fluid from said container assembly.

18. The container assembly of claim 17, in which said corner is rounded.

19. A method of pouring fluid from a container, including the steps of:

(a) providing a lid of claim 1 assembled on a container with drainable contents therein;

(b) tearing said tearstrip on said container assembly; and (c) pouring said contents from said container.

20. The method of claim 19, in which said tearstrips are separable from said container assembly, and said method includes the step of separating said tearstrips from said container assembly.

21. The method of claim 19, in which said container assembly includes at least two tearstrip openings positioned on substantially opposite sides of said container assembly, and the method includes the step of tearing said at least two substantially oppositely positioned tearstrips.

22. A container lid, including:

a central portion configured to be disposed over an opening of a cooperating container;

a rim portion at the periphery of said central portion, said rim portion configured for mating engagement with a corresponding container; and at least one removable portion completely on said rim portion positioned so that removal of said removable portion provides an opening through said rim portion into a cooperating container, said opening having two sides being substantially parallel to a sidewall of the container, in which the length of said two sides is not less than the distance between said two sides.

23. The container lid of claim 22, in which protective shield members are provided adjacent at least one of said one or more removable portions.

24. The container lid of claim 22 or claim 23, including resealing means for covering said opening after removal of at least one of said one or more removable portions.

25. A lid and container combination, including a container having an opening thereon, said opening defined by a substantially vertical lip portion, a lid configured to cover said opening, engagement means for maintaining desired engagement between said lid and said container, said lid including a rim portion configured in a substantially upside-down U-shaped cross-section, said U-shaped cross-section dimensioned and configured to substantially straddle said lip portion of said container, and one or more removable sections of said rim portion positioned adjacent said lip portion of said container and within said U-shaped cross-section and providing a passageway into said container upon removal of said one or more removable sections.

26. The combination of claim 25, in which at least two said removable sections are on said rim portion, said at least two portions being spaced on substantially opposite sides of said lid.

27. The combination of claim 25, including a secondary vent opening spaced from at least one of said removable sections.

28. The combination of claim 25 or claim 26 or claim 27, in which said container is a shipping container with a bottom shaped to be stackable atop like lids.

29. The combination of claim 28, in which said lid includes a central portion surrounded by said rim portion, and said container has sides tapered so that the bottom of the container is sufficiently small to abut against said central portion of said lid.

30. A lid having a perimetrical channel with a tearstrip drainage opening within said perimetrical channel, said tearstrip drainage opening substantially aligned with an edge of a mating shipping container and further located so that said opening permits the contents of the container to be poured therethrough, said drainage opening having no edge coterminous with an edge of said lid.

* * * * *